US009689565B2

(12) United States Patent
Fryzek

(10) Patent No.: US 9,689,565 B2
(45) Date of Patent: Jun. 27, 2017

(54) RECESSED LUMINAIRE ADJUSTMENT MECHANISM

(71) Applicant: ABL IP Holding LLC, Decatur, GA (US)

(72) Inventor: Aaron P. Fryzek, Wheaton, IL (US)

(73) Assignee: ABL IP Holding LLC, Decatur, GA (US)

( * ) Notice: Subject to any disclaimer, the term of this patent is extended or adjusted under 35 U.S.C. 154(b) by 96 days.

(21) Appl. No.: 14/621,533

(22) Filed: Feb. 13, 2015

(65) Prior Publication Data

US 2015/0241039 A1 Aug. 27, 2015

Related U.S. Application Data

(60) Provisional application No. 61/945,346, filed on Feb. 27, 2014.

(51) Int. Cl.
*F21V 21/30* (2006.01)
*F21V 21/14* (2006.01)
(Continued)

(52) U.S. Cl.
CPC ..... *F21V 21/30* (2013.01); *F21S 8/026* (2013.01); *F21V 21/04* (2013.01); *F21V 21/041* (2013.01);
(Continued)

(58) Field of Classification Search
CPC ..... F21V 21/30; F21V 21/26; F21V 21/28; F21V 21/04; F21V 21/041; F21V 21/047; F21V 21/14; F21S 8/026
See application file for complete search history.

(56) References Cited

U.S. PATENT DOCUMENTS 3,609,346 A * 9/1971 Lund ..... F21S 8/02 362/364
3,660,651 A * 5/1972 Miles, Jr. ..... F21S 8/026 362/364

(Continued)

FOREIGN PATENT DOCUMENTS

AT DE 102014205663 B4 * 3/2016 ..... F21S 8/026
DE 202013104140 * 11/2013
GB 2508300 * 5/2014

OTHER PUBLICATIONS

Office Action for Mexican Patent Application No. MX/a/2015/002078, mailed Jul. 22, 2016, 4 pages (2 pages for English translation, 2 pages for MX Office Action).

*Primary Examiner* — Eret McNichols
(74) *Attorney, Agent, or Firm* — Kilpatrick Townsend & Stockton, LLP

(57) ABSTRACT

An adjustment mechanism for directional recessed luminaires includes a tilt adjustment screw 104 and rotation adjustment screw 124 supported in adjacent positions on a bearing ring 102, the screws being oriented vertically and conveniently accessible through an open center of the bearing ring. Follower 106 travels vertically on the tilt adjustment screw when rotated. Drive link 108 connected to both the follower and a four bar linkage (110), transfers force from the follower to the linkage when the tilt screw is rotated. The linkage pivots about anchor points 114,116 and is pivotally connected to lamp carrier frame 118 supporting light source 105. When the tilt adjustment screw is rotated, light source moves along a path (FIG. 6, 7) to aim the light beam. After aiming, the mechanism locks the light source into place. The mechanism is compact and the adjustment screws are easily accessible from beneath the mechanism.

18 Claims, 7 Drawing Sheets

(51) Int. Cl.

| | |
|---|---|
| ***F21S 8/02*** | (2006.01) |
| ***F21V 21/04*** | (2006.01) |
| ***F21V 21/28*** | (2006.01) |
| ***F21V 21/26*** | (2006.01) |

(52) U.S. Cl.
CPC ..... *F21V 21/047* (2013.01); *F21V 21/14* (2013.01); *F21V 21/26* (2013.01); *F21V 21/28* (2013.01)

(56) References Cited

U.S. PATENT DOCUMENTS 3,974,371 A * 8/1976 Miles, Jr. ..... F21S 8/02 362/341
4,142,227 A * 2/1979 Aikens ..... B60H 1/3442 362/364
6,471,374 B1 * 10/2002 Thomas ..... F21S 8/02 362/285
7,431,482 B1 * 10/2008 Morgan ..... F21S 2/005 362/249.07
7,434,967 B2 * 10/2008 Dupre ..... F21S 8/026 362/366
7,748,868 B2 7/2010 Patti et al.
7,950,834 B2 * 5/2011 Dupre ..... F21S 8/026 362/370
8,100,565 B2 * 1/2012 Patti ..... F21S 8/02 362/275
8,215,805 B2 7/2012 Cogliano et al.
8,226,278 B2 * 7/2012 Ward ..... F21S 8/02 362/365
8,226,878 B2 7/2012 Chen et al.
8,777,459 B2 * 7/2014 Patti ..... F21S 8/02 362/287
8,944,648 B1 * 2/2015 Dupre ..... F21S 8/026 362/269
9,004,728 B2 * 4/2015 Thompson ..... F21S 8/026 362/145
9,134,016 B2 * 9/2015 David ..... F21S 8/026
9,239,149 B2 * 1/2016 Vice ..... F21V 14/02
2015/0078012 A1 * 3/2015 Delano ..... F21S 8/02 362/365
2015/0241038 A1 * 8/2015 Fryzek ..... F21S 8/026 362/147
2016/0186967 A1 * 6/2016 Mathews ..... F21V 21/30 362/368

* cited by examiner

DOWNLIGHT POSITION

RECESSED LUMINAIRE ADJUSTMENT MECHANISM

This patent application claims benefit under 35 U.S.C. 119(e), of the earlier filing date of U.S. Provisional Patent Application Ser. No. 61/945,346, filed Feb. 27, 2014.

BACKGROUND OF THE INVENTION

1. Field of the Invention

The invention disclosed relates generally to luminaires and in particular to directional recessed luminaires.

2. Discussion of the Related Art

A luminaire is generally considered to be a complete lighting unit consisting of a lamp or lamps together with the parts designed to distribute the light, to position and protect the lamps, and to connect the lamps to the power supply. Recessed luminaires are generally installed into a hollow opening in a ceiling and are designed to be minimally visible from below. A trim ring typically surrounds the opening in the ceiling, to mask the opening, add aesthetic appeal, and help distribute the light in some configurations. Selecting lighting systems in the interior design of buildings requires consideration of the objective for each area to be illuminated. There are many styles of recessed luminaires to fulfill a variety of lighting objectives, such as general illumination in lobbies, halls, and work areas, wall wash illumination to throw light onto a wall for an ambience effect, and accent lighting to focus on art objects and building surfaces. Recessed wall wash and accent luminaires may include an internal direction adjustment mechanism for the rotation and elevation of the light beam to be directed on to an object or surface. During the installation of directional recessed luminaires for wall wash or accent illumination, the lamp must be energized while the installer adjusts the direction of the light beam, to obtain the desired lighting effect. Precise aiming of the light beam often requires repeated adjustments, first in the vertical direction, and then in the horizontal direction, to position the light beam onto the intended object. For many currently available directional recessed luminaires, this has been an inconvenient and tedious operation.

Directional recessed luminaires are available, wherein the lamp is supported on linkage arms to enable vertical tilt and horizontal rotation adjustments. An example directional recessed luminaire is described in U.S. Pat. No. 8,215,805, which depicts a lamp assembly supported on a bearing ring by four pivoted linkage arms, to allow adjustment of an angle of vertical tilt of the lamp holder with a tilt adjustment screw. A rotational adjustment screw allows adjustment of a horizontal direction of the lamp holder, by rotating the bearing ring with respect to a stationary crown gear. The tilt adjustment screw is located in a first bore hole on one side of the bearing ring and the rotational adjustment screw is located in a second bore hole in the bearing ring on the opposite side of the bearing ring. During installation, in order to direct the light beam on an object intended to be illuminated, the installer must orient a screwdriver in one direction to locate the tilt adjustment screw, and then in the opposite direction to locate the rotation adjustment screw. Repeated adjustments to position the light beam, first in the vertical direction, and then in the horizontal direction, requires repeatedly reorienting the screwdriver in opposite directions. This makes the installation an inconvenient and tedious operation.

Accordingly, there is a need for a directional recessed luminaire that provides convenient access to direction adjustment screws for tilt and rotation during installation. There is a need for a directional recessed luminaire that provides for convenient aiming of the light beam by the lamp assembly and for easily locking the lamp assembly into a desired aiming position.

SUMMARY OF THE INVENTION

Example embodiments of the invention enable convenient installation in a ceiling, of directional recessed luminaires for wall wash, accent illumination, and other lighting applications. In example embodiments of the invention, a directional recessed luminaire provides convenient access to direction adjustment screws for tilt and rotation during installation through a cutout opening in the ceiling. Repeated adjustments to position the light beam may be accomplished without reorienting the screwdriver between tilt and rotational adjustments. Example embodiments of the invention provide an improved design of an adjustment mechanism for a directional recessed luminaire, by positioning the tilt and rotation adjustment screws in adjacent positions on a bearing ring. The tilt and rotation screws are oriented in the vertical direction and are conveniently accessible for rotation by the screwdriver inserted from beneath the luminaire, through the cutout opening in the ceiling.

In example embodiments of the invention, the tilt adjustment screw is configured to adjust a vertical tilt of a lamp carrier frame supported on the bearing ring, to vertically lift or lower a direction of light from a light source in the lamp carrier frame, with respect to an area to be illuminated by the light source. The rotation adjustment screw is supported in an adjacent position to the tilt adjustment screw on the bearing ring. The rotation adjustment screw is configured to adjust a horizontal angle orientation of the lamp carrier frame by rotating the bearing ring to horizontally rotate the direction of light from the light source, with respect to the area to be illuminated.

In accordance with an example embodiment of the invention, rotation of the tilt adjustment screw causes a follower to travel in the vertical direction on the threaded tilt adjustment screw. A drive link that is connected to both the follower and a first linkage of the adjustment mechanism, transfers force to the first linkage. This force causes the first linkage and a second linkage of the adjustment mechanism, to pivot about their anchor points on a third linkage that is part of a bearing ring. This pivoting motion of the first and second linkages results in arcuate motion of a fourth linkage to which they are pivotally connected. The fourth linkage is part of the lamp carrier frame, thereby causing arcuate motion of the lamp carrier frame and light source along a path defined by the adjustment mechanism. Precise adjustment positions of the lamp carrier frame and the light source may then be achieved.

The design of the adjustment mechanism for a directional recessed luminaire eliminates the need for secondary locks. The aiming angle of the mechanism is set via rotating the tilt adjustment screw, which in turn drives the position of the first linkage. Once the desired angle is achieved, the position cannot be changed unless the tilt adjustment screw is intentionally turned. Applying force to any part of the adjustment mechanism, except the tilt adjustment screw, will not cause the tilt adjustment screw to move or the aiming position to change, thus resulting in a locked position without traditional "locks".

In accordance with an example embodiment of the invention, rotation of the rotation adjustment screw is transferred to an upper rotation gear that is fixed to the rotation adjustment screw. The upper rotation gear turns a lower rotation gear that is engaged with a ring gear. As the rotation adjustment screw is turned, the assembly of the lamp carrier frame, light source, and bearing ring is precisely turned inside the ring gear. The ring gear remains stationary and fastened to a support platform, such as a ceiling.

In this manner, the directional recessed luminaire provides for convenient aiming of the light beam from the light source and for easily locking the light source into a desired aiming position. The directional recessed luminaire provides for convenient tilt and rotational adjustment of the light beam from the light source.

DETAILED DESCRIPTION OF EMBODIMENTS OF THE INVENTION

Figure 1:
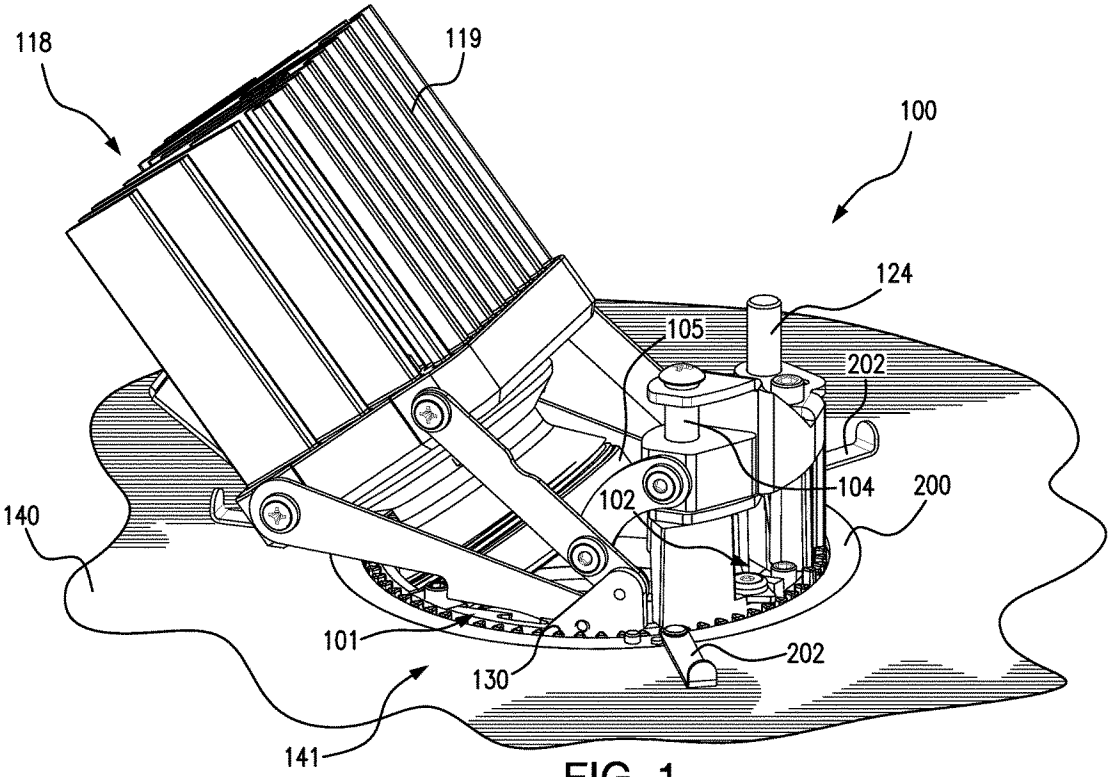
FIG. 1 is a top front perspective view from the right side, of an overall example of an adjustment mechanism for a directional recessed luminaire mounted above a cutout opening of a ceiling. The figure shows the luminaire mounted with an example remodel frame for use in non-insulated areas. Support levers of the example mounting are shown overlapping the back surface of the ceiling in the area of the back surface surrounding the cutout opening.

FIG. 1 is a top front perspective view from the right side, of an example adjustment mechanism for a directional recessed luminaire 100, mounted above a cutout opening 141 of a ceiling 140. The figure shows the adjustment mechanism for the directional recessed luminaire 100 mounted with an example remodel frame comprising an upper frame 200 for use in remodeling applications in non-insulated areas. Support levers 202 of the example upper frame 200 are shown overlapping the back surface of the ceiling 140 in the area of the back surface surrounding the cutout opening 141. The support levers 202 support the upper frame 200 in the cutout opening 141, which supports a stationary ring gear 130. A bearing ring 102 is positioned within the stationary ring gear 130 and is configured to rotate within the ring gear. The bearing ring 102 supports a four bar linkage adjustment mechanism 101. The four bar linkage adjustment mechanism 101 supports a lamp carrier frame 118 that includes a heat sink 119 and a light source 105.

Figure 2:
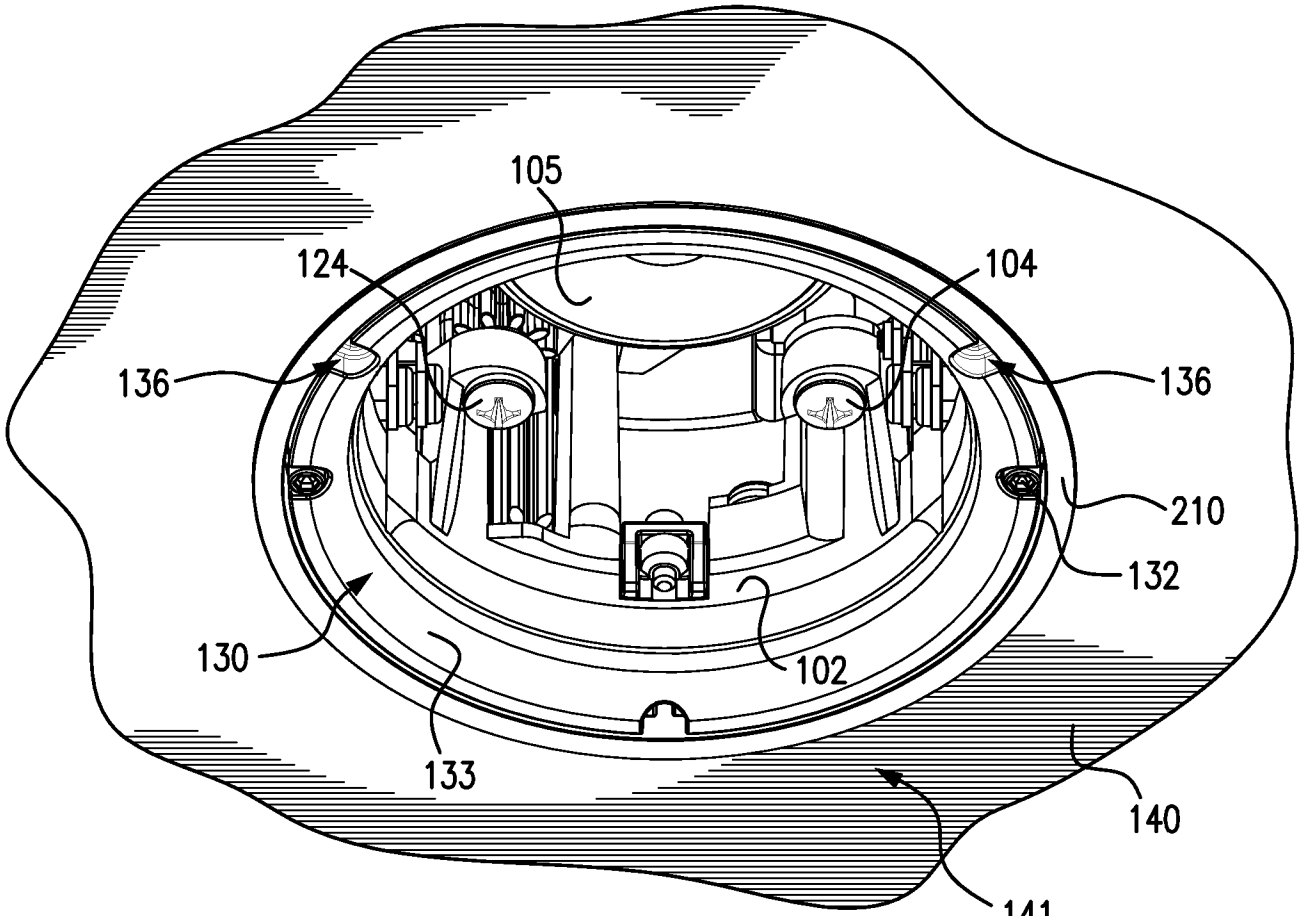
FIG. 2 is a bottom front perspective view of the example adjustment mechanism for the directional recessed luminaire shown in FIG. 1, showing access to a tilt adjustment screw and a rotation adjustment screw through the cutout opening of the ceiling.

FIG. 2 is a bottom front perspective view of the example adjustment mechanism for the directional recessed luminaire 100 shown in FIG. 1, showing access to a tilt adjustment screw 104 and a rotation adjustment screw 124 through the cutout opening 141 of the ceiling 140. A lower rim 133 on the stationary ring gear 130 of the luminaire 100, is fastened by screws 132 in slots 136, to a lower frame 210 of the remodel frame. The lower frame 210 is fastened to the upper frame 200 (shown in FIG. 1) that is supported by the support levers 202, shown in FIG. 1.

Several components of the luminaire 100, which are located above the level of the ceiling 140, may be seen through the cutout opening 141. The tilt adjustment screw 104 and rotation adjustment screw 124 are shown supported in adjacent positions on the bearing ring 102, to enable an installer to conveniently access the screws 104 and 124 to adjust the direction of the light beam. The tilt and rotation screws 104 and 124 are oriented in the vertical direction and are conveniently accessible for rotation by a tool, such as a screwdriver, inserted through the open center of the bearing ring 102 positioned in the cutout opening 141 in the ceiling 140. Repeated adjustments to position the light beam may be accomplished without the installer having to reorient the screwdriver between tilt and rotational adjustments.

Various types of mountings may be used to support the adjustment mechanism for a directional recessed luminaire 100 above the ceiling 140. In remodeling applications where the luminaire and adjustment mechanism must be installed through the cutout opening 141 of the ceiling 140, a remodel frame may be used for either a round cutout opening 141, similar to that depicted in FIGS. 1 and 2, or a square cutout opening. In new construction applications in non-insulated areas, a flat mounting frame may be used that is suspended by bar hangers fastened between joists above the ceiling. In new construction applications in insulated areas, a box-shaped recessed luminaire housing may be used that can be directly covered with insulation, which is suspended by bar hangers fastened between joists above the ceiling.

Figure 3:
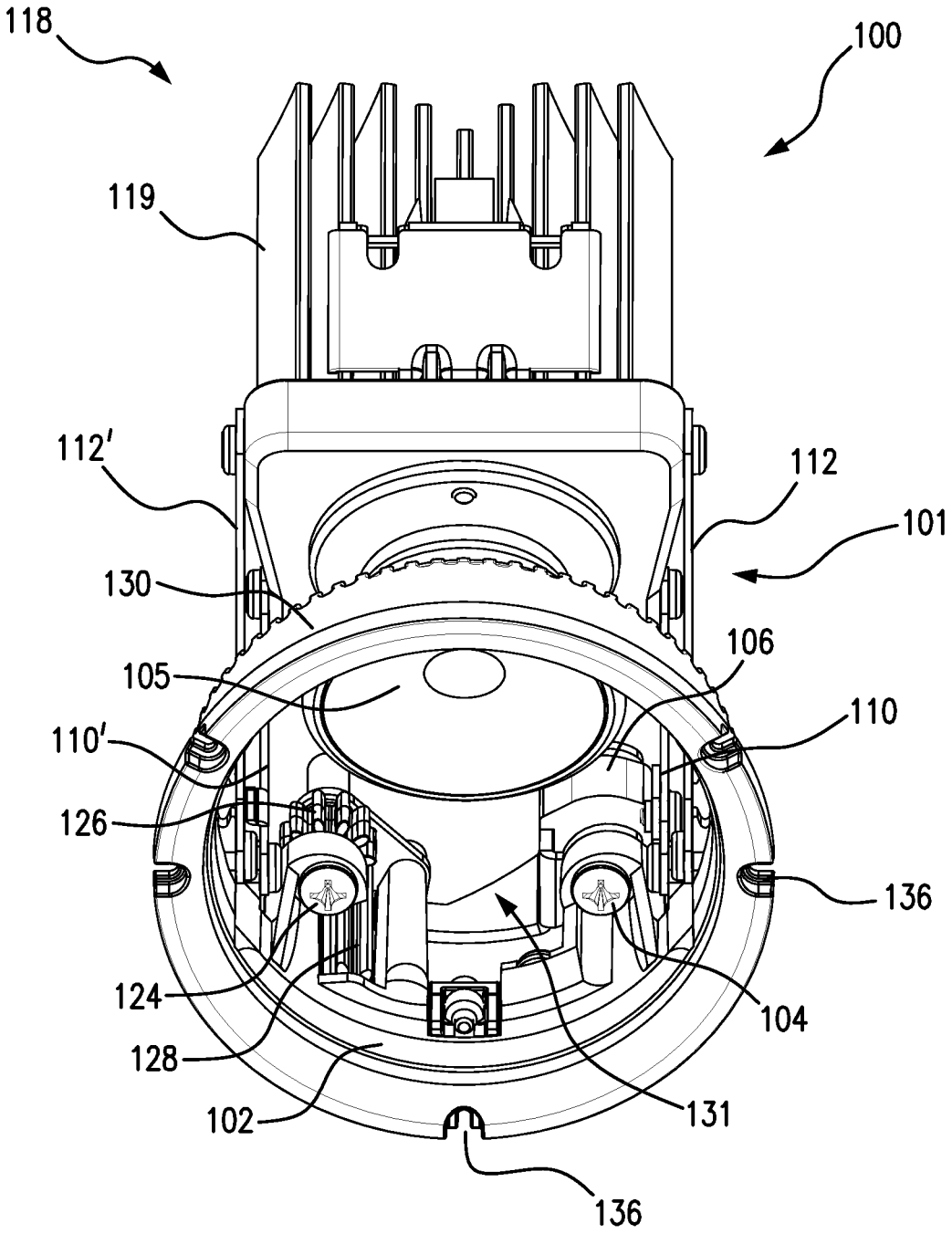
FIG. 3 is a bottom front perspective view of an example four bar linkage adjustment mechanism for the directional recessed luminaire of FIG. 1, showing the tilt adjustment screw and the rotation adjustment screw mounted in adjacent positions in the bearing ring of the luminaire.

FIG. 3 is a bottom front perspective view of the example four bar linkage adjustment mechanism 101 for the directional recessed luminaire 100 of FIG. 1, showing the tilt adjustment screw 104 and the rotation adjustment screw 124 mounted in adjacent positions in the bearing ring 102 of the luminaire 100. The figure shows the light source 105 exposed through the open center 131 of the ring gear 130. The tilt adjustment screw 104 and the rotation adjustment screw 124 are vertically accessible through the open center 131 of the ring gear 130, from beneath the luminaire 100.

The tilt adjustment screw 104 is configured to adjust the vertical tilt of the lamp carrier frame 118 supported on the bearing ring 102, to vertically lift or lower a direction of light from light source 105 in the lamp carrier frame 118, with respect to an area to be illuminated by the light source.

The rotation adjustment screw 124 is supported in an adjacent position to the tilt adjustment screw 104 on the bearing ring 102, the rotation adjustment screw being oriented in the vertical direction. The rotation adjustment screw 124 is configured to adjust a horizontal angle orientation of the lamp carrier frame 118, by driving the bearing ring 102 to rotate in the horizontal direction with respect to stationary ring gear 130 and the ceiling 140.

The design of the directional recessed luminaire 100 is installer friendly. The two screws 104 and 124 for controlling position of the adjustment mechanism, are readily accessible and located in close proximity to each other, providing an intuitive means for adjustment. There is no need to remove the directional recessed luminaire 100 to adjust the aiming angle.

Figure 4:
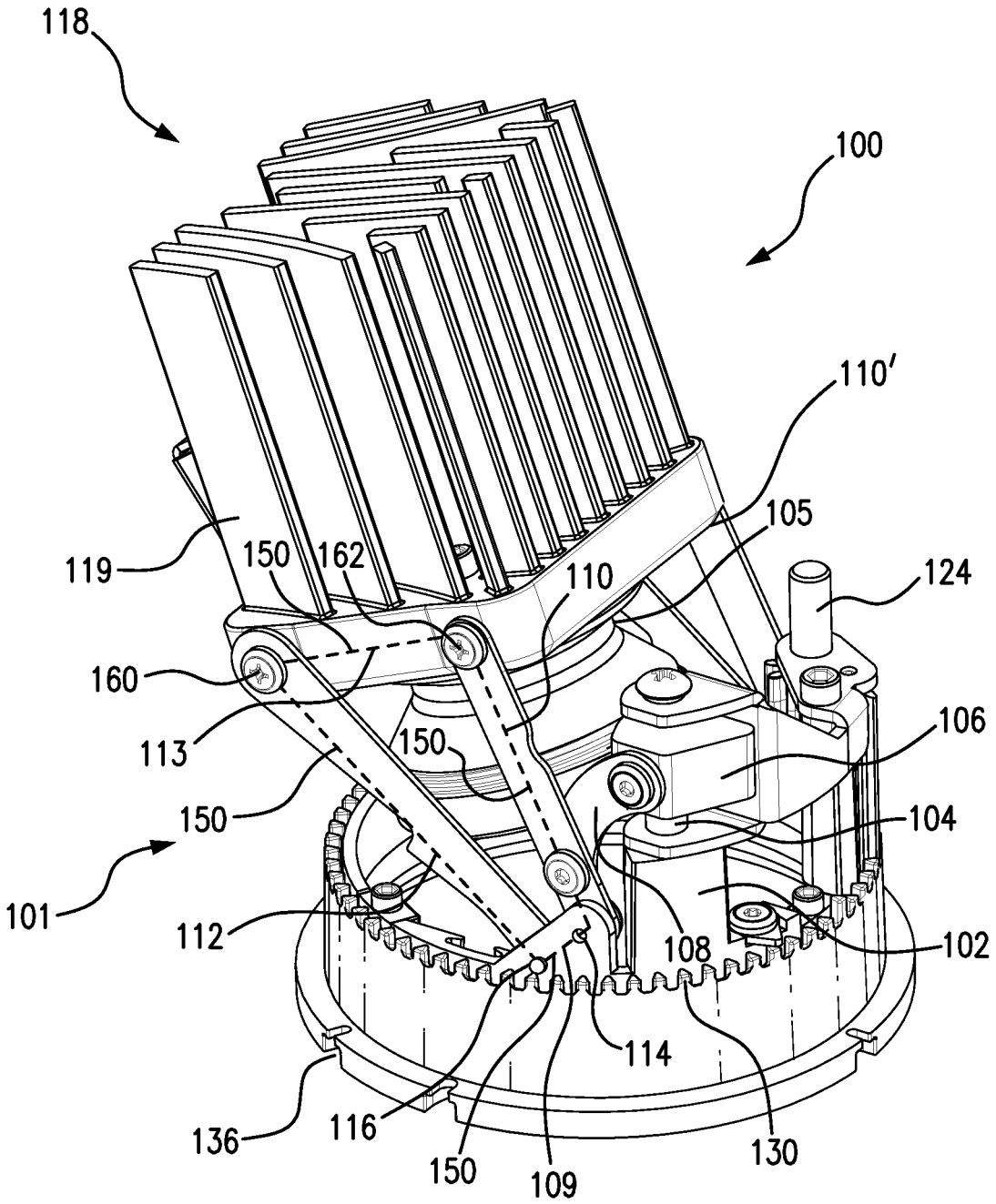
FIG. 4 is a top front perspective view from the right side, of the example four bar linkage adjustment mechanism for a directional recessed luminaire of FIG. 1.

FIG. 4 is a top front perspective view from the right side, of the example four bar linkage adjustment mechanism 101 for a directional recessed luminaire 100 of FIG. 1. The figure shows the tilt adjustment screw 104 mounted in the bearing ring 102 of the luminaire 100, which may be rotated with a screwdriver to provide for vertical aiming of a light beam from the light source 105 and lamp carrier frame 118 of the luminaire 100. The lamp carrier frame 118 may include the heat sink 119 to help dissipate heat generated by the light source. The four bar linkage adjustment mechanism 101, provides for easily locking the light source 105 into a desired aiming position.

Figure 5:
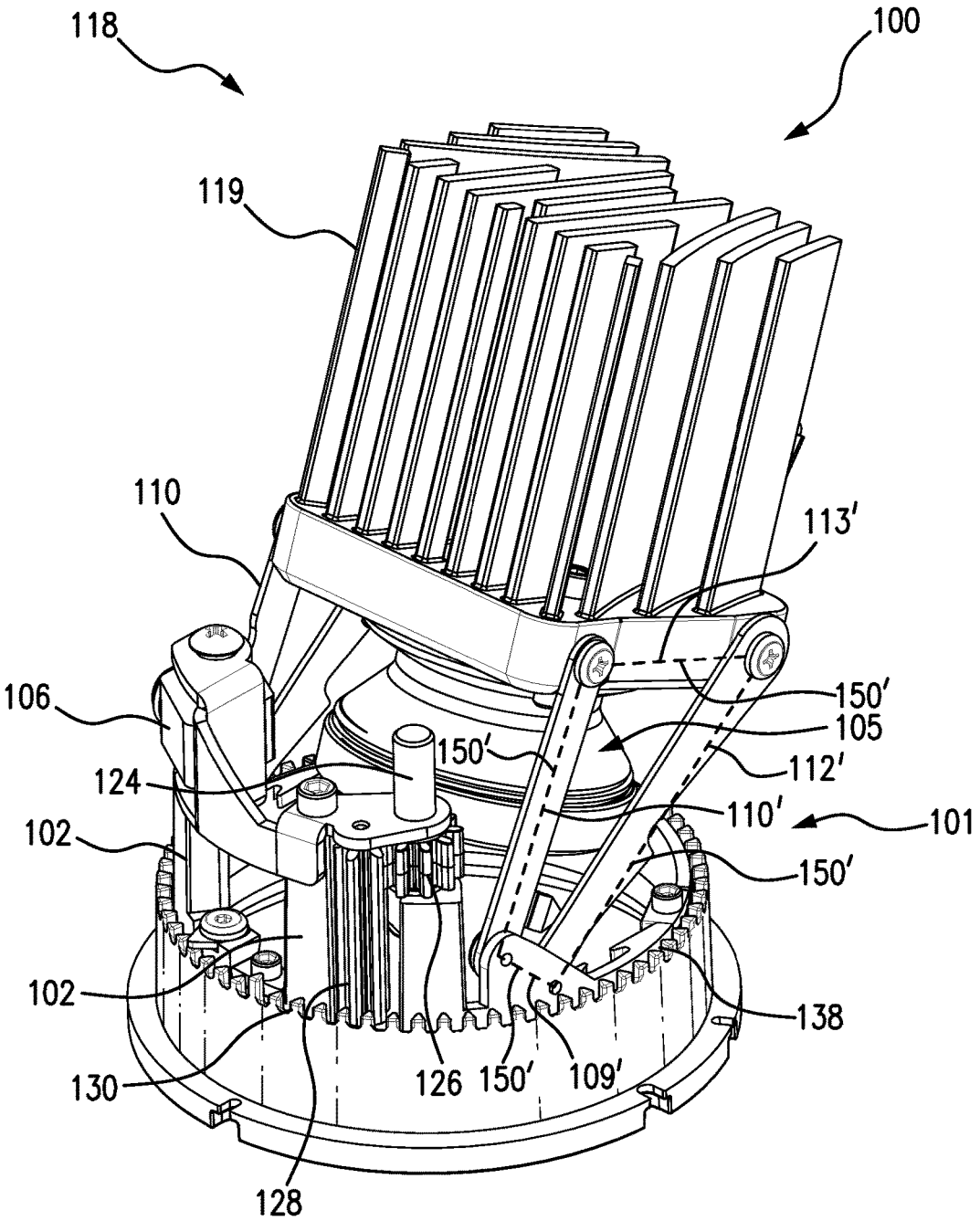
FIG. 5 is a top front perspective view from the left side, of the example four bar linkage adjustment mechanism for the directional recessed luminaire of FIG. 4.

In accordance with an example embodiment of the invention, aiming of the light source 105 and lamp carrier frame 118 is accomplished by rotating the tilt adjustment screw 104 with a screwdriver. This rotation causes a follower 106 to travel in the vertical direction on the threaded tilt adjustment screw 104. A drive link 108 that is connected to both the follower 106 and a first linkage 110 of the four bar linkage adjustment mechanism 101, transfers force to the first linkage 110. This force causes the first linkage 110 and a second linkage 112 of the four bar linkage adjustment mechanism 101, to pivot about their respective anchor points 114 and 116 on a third linkage 109 that is part of the bearing ring 102. This pivoting motion of the first linkage 110 and second linkage 112 results in arcuate motion of a fourth linkage 113 to which they are pivotally connected at their respective pivots 162 and 160. The fourth linkage 113 is part of the lamp carrier frame 118, thereby causing arcuate motion of the lamp carrier frame 118 and light source 105 along a path defined by the four bar linkage adjustment mechanism 101, as shown in FIGS. 4 and 5. Precise adjustment positions of the lamp carrier frame 118 and the light source 105 may then be achieved.

The four bar linkage adjustment mechanism 101 comprises the set of four linkages 109, 110, 112, and 113 that form a planar four-bar linkage 150 located on the right side of the luminaire 100. The four bar linkage adjustment mechanism 101 further comprises a similar, set of four linkages 109', 110', 112', and 113' that form a planar four-bar linkage 150' located on the left side of the luminaire 100, as shown in FIG. 5. A four-bar linkage is the simplest movable closed chain linkage and consists of four bodies, called bars or linkages, connected in a loop by four joints. Generally, the joints are configured so the linkages move in parallel planes for a planar four-bar linkage.

The planar four-bar linkage 150 is driven by the drive link 108 when the follower 106 moves vertically on the tilt adjustment screw 104, to pivot about the anchor points 114 and 116 on the third linkage 109 that is part of the bearing ring 102. This pivoting motion of the planar four-bar linkage 150 results in arcuate motion of the lamp carrier frame 118. The arcuate motion of the lamp carrier frame 118 carries along the set of four linkages 109', 110', 112', and 113' forming the planar four-bar linkage 150' located on the left side of the luminaire 100, as shown in FIG. 5. The planar four-bar linkage 150' located on the left side, provides stability to the motion of the lamp carrier frame 118 and light source 105. In this manner, the lamp carrier frame 118 and light source 105 are moved along the path shown in FIGS. 6 and 7, to adjust the light beam from being directed vertically down, to a light beam directed at an acute angle to vertical.

The example embodiments of the invention allow maximum horizontal and vertical precision adjustment in a very compact form factor that may be installed and removed from below a finished ceiling. No external frame is required to act as a guide for the light source, which would prohibit removal and/or adjustment of the light source. The four bar linkage adjustment mechanism is compact and yet provides a wide range of motion. Optimum positions of the light source may be achieved from a light beam directed straight down to a light beam directed at an acute angle to vertical. The four bar linkage adjustment mechanism and travel path of the light source and lamp carrier frame provide the best position relative to efficiency and aesthetic appeal possible with the given optical elements.

The design of the four bar linkage adjustment mechanism 101 eliminates the need for secondary locks. The vertical aiming angle of the mechanism is set via rotating the tilt adjustment screw 104. The follower 106 is in threaded engagement with the tilt adjustment screw 104 and travels in a vertical direction on the threaded tilt adjustment screw 104 when the screw 104 is rotated. The motion of the follower 106 forces the pivoting of the first 110 and second 112 linkages, to precisely move the lamp carrier frame 118 and light source 105 along a path defined by the four bar linkage adjustment mechanism 101. Once the desired angle of the light beam is achieved, the position cannot be changed unless the tilt adjustment screw 104 is intentionally turned. Applying force to any part of the four bar linkage adjustment mechanism 101 (except the tilt adjustment screw 104) will not cause the tilt adjustment screw 104 to move or the aiming position to change, thus resulting in a locked position without traditional "locks".

The figure also shows the rotation adjustment screw 124 mounted in the bearing ring 102 of the luminaire 100, which may be rotated from below with a screwdriver. The rotation adjustment screw 124 provides for precision rotation of the light beam, light source 105, lamp carrier frame 118, and bearing ring 102 within the ring gear 130. The ring gear 130 remains stationary and fastened to the ceiling 140 (as shown in FIG. 2).

FIG. 5 is a top front perspective view from the left side, of the example four bar linkage adjustment mechanism 101 for the directional recessed luminaire 100 of FIG. 4. The figure shows the rotation adjustment screw 124 mounted in the bearing ring 102 of the luminaire 100, which may be rotated with a screwdriver. The rotation adjustment screw 124 provides for precision rotation of the light beam, light source 105, lamp carrier frame 118, and bearing ring 102 within the ring gear 130. The ring gear 130 remains stationary and fastened to a ceiling 140 (shown in FIG. 2).

In accordance with an example embodiment of the invention, the light source 105 and lamp carrier frame 118 may be rotated by means of rotating the rotation adjustment screw 124 with a screwdriver from below. This rotational motion is transferred to an upper rotation gear 126 that is fixed to the rotation adjustment screw 124. The upper rotation gear 126 turns a lower rotation gear 128 that is engaged with the ring gear 130. As the rotation adjustment screw 124 is turned, the assembly of the lamp carrier frame 118, light source 105, and bearing ring 102 is precisely turned inside the ring gear 130. The ring gear 130 remains stationary and fastened to the ceiling 140 (shown in FIG. 2).

Figure 6:
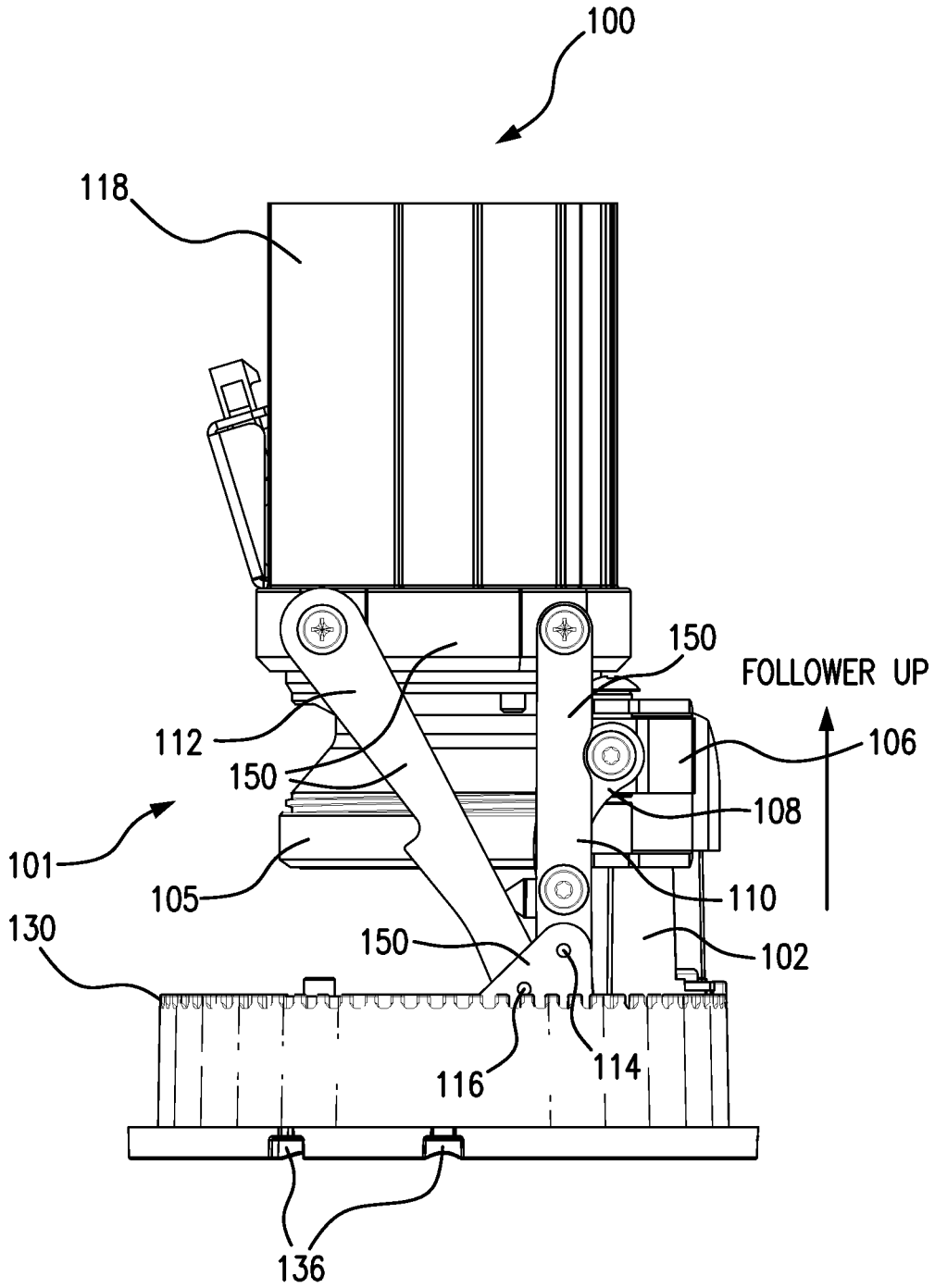
FIG. 6 is a side view from the right side, of the example four bar linkage adjustment mechanism for the directional recessed luminaire of FIG. 1, showing a minimum adjustment position adjusted by the tilt adjustment screw, which directs the light beam in a vertical, downward direction through the open center of the ring gear.

FIG. 6 is a side view from the right side, of the example four bar linkage adjustment mechanism 101 for the directional recessed luminaire 100 of FIG. 1, showing a minimum adjustment position adjusted by the tilt adjustment screw 104, which directs the light beam in a vertical, downward direction through the open center of the ring gear 130. Rotation of the tilt adjustment screw 104 moves the follower 106 upward in the vertical direction on the threaded tilt adjustment screw 104, causing the drive link 108 to transfer force to the first linkage 110 to pull the lamp carrier frame and light source to the minimum adjustment position, thereby directing the light beam in the vertical, downward direction.

In an example embodiment of the invention, if the diameter of the ring gear 130 is two inches, then the approximate length (in inches) of the four linkages 109, 110, 112, and 113 on the right side, forming the planar four-bar linkage 150 may be:

| Linkage | Length (in) |
|---|---|
| 110 | 1.15 |
| 112 | 1.46 |
| 109 | 0.18 |
| 113 | 0.86 |

The same approximate length (in inches) would apply to the set of four linkages 109', 110', 112', and 113' that form the planar four-bar linkage 150' located on the left side forming the planar four-bar linkage 150' shown in FIG. 5. The example lengths of linkages given in the above table, corresponding to a diameter of the ring gear 130 of two inches, are only one of many possible combinations of values.

The resulting the planar four-bar linkage 150 is driven by the drive link 108 when the follower 106 moves vertically on the tilt adjustment screw 104, to pivot about the anchor points 114 and 116 on a third linkage 109 that is part of the bearing ring 102. This pivoting motion of the planar four-bar linkage 150 results in arcuate motion of the lamp carrier frame 118. The arcuate motion of the lamp carrier frame 118 carries along the set of four linkages 109', 110', 112', and 113' forming the planar four-bar linkage 150' located on the left side of the luminaire 100, as shown in FIG. 5. The planar four-bar linkage 150' located on the left side, provides stability to the motion of the lamp carrier frame and light source. In this manner, the lamp carrier frame 118 and light source 105 are translated along the path shown in FIGS. 6 and 7, to adjust the light beam from being directed straight down, to a light beam directed at an acute angle to vertical.

Figure 7:
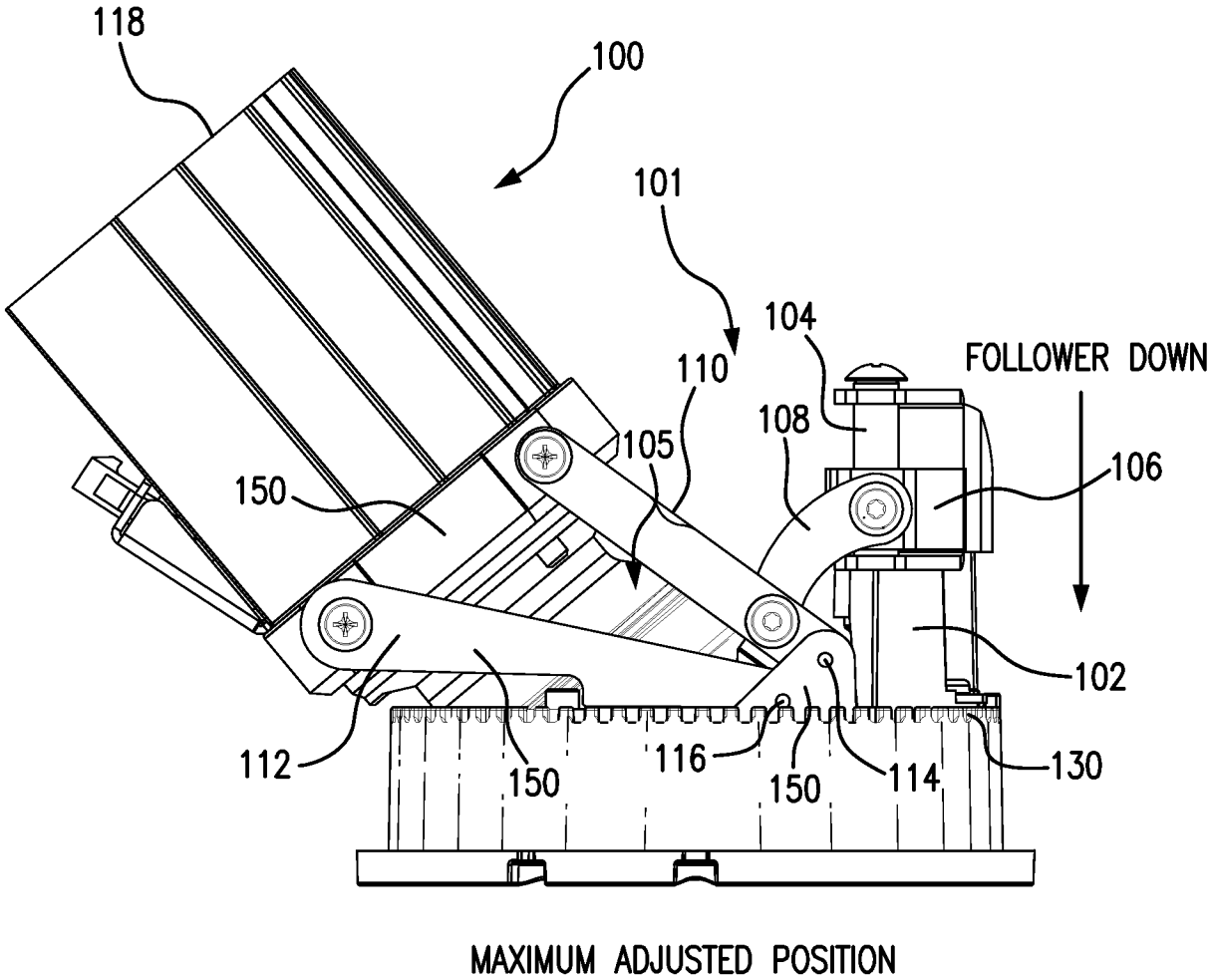
FIG. 7 is a side view from the right side, of the example four bar linkage adjustment mechanism for the directional recessed luminaire, showing a maximum adjustment position, which directs the light beam at an acute angle to the vertical, through the open center of the ring gear.

FIG. 7 is a side view from the right side, of the example four bar linkage adjustment mechanism 101 for the directional recessed luminaire 100, showing a maximum adjustment position, which directs the light beam at an acute angle to the vertical, through the open center of the ring gear 130. Rotation of the tilt adjustment screw 104 moves the follower 106 downward in the vertical direction on the threaded tilt adjustment screw 104, causing the drive link 108 to transfer force to the first linkage 110 to push the lamp carrier frame 118 and light source 105 to the maximum adjustment position, which directs the light beam at an acute angle to the vertical.

The form factor of the example embodiments of the directional recessed luminaire 100, provides compatibility with a wide range of traditional style finishing trims, such as parabolic reflectors, hyperbolic reflectors, angle cut reflectors, lensed reflectors, wall wash trims, pinholes trims, and the like.

The modular design of the example embodiments of the directional recessed luminaire 100, enables the operating principle the luminaire to be used in various configurations and shapes, such as round new construction, round remodel construction, square remodel, and square new construction, with minimal changes to components. The modular design also contributes to improving the manufacturability of products using the operating principle the luminaire 100.

Example embodiments of the directional recessed luminaire 100 may be used in residential or commercial environments, where accent lighting (highlighting specific elements of the space, such as architecture or artwork) or general lighting is desired. Example embodiments may be used in luminaires that are recessed into a ceiling cavity of a structure.

In this manner, the directional recessed luminaire provides for convenient aiming of the light beam from the light source and for easily locking the light source into a desired aiming position. The directional recessed luminaire provides for convenient tilt and rotational adjustment of the light beam from the light source.

The invention claimed is:

1. An adjustment mechanism for a directional recessed luminaire comprising:

a tilt adjustment screw engaged with a bearing ring of a directional recessed luminaire, the tilt adjustment screw being oriented in a vertical direction and accessible for rotation by a tool inserted through an open center of the bearing ring, the tilt adjustment screw being configured to adjust a vertical tilt of a lamp carrier frame supported on the bearing ring, to vertically lift or lower a direction of light from a light source in the lamp carrier frame, with respect to an area to be illuminated by the light source;

a rotation adjustment screw engaged with the bearing ring in an adjacent position to the tilt adjustment screw, the rotation adjustment screw being oriented in the vertical direction and accessible for rotation by the tool inserted through the open center of the bearing ring, the rotation adjustment screw being configured to adjust a horizontal angle orientation of the lamp carrier frame by rotating the bearing ring, to horizontally rotate the direction of light from the light source, with respect to the area to be illuminated;

a follower in threaded engagement with the tilt adjustment screw, the follower being configured to travel in the vertical direction on the tilt adjustment screw when the tilt adjustment screw is rotated;

a drive link connected to both the follower and a first linkage of a four bar linkage adjustment mechanism of the directional recessed luminaire, the drive link being configured to transfer force from the follower to the first linkage when the tilt adjustment screw is rotated;

the first linkage and a second linkage of the four bar linkage adjustment mechanism, being configured to pivot about respective first and second anchor points on a third linkage that is part of the bearing ring;

the first and second linkages being pivotally connected to respective first and second pivots on a fourth linkage of the four bar linkage adjustment mechanism, the fourth linkage being part of the lamp carrier frame that supports the light source of the directional recessed luminaire; and the pivoting of the first and second linkages, being configured to move the fourth linkage, lamp carrier frame, and light source along a path defined by the four bar linkage adjustment mechanism, when the tilt adjustment screw is rotated.

2. The adjustment mechanism for a directional recessed luminaire of claim 1, wherein once an aiming angle of the light source is set by rotating the tilt adjustment screw to position the follower along the tilt adjustment screw, the aiming angle is locked and cannot be changed by applying force to the adjustment mechanism in the absence of rotating the tilt adjustment screw.

3. The adjustment mechanism for a directional recessed luminaire of claim 1, further comprising:

an upper rotation gear being configured to rotate with the rotation adjustment screw;

a lower rotation gear being configured to engage with and be driven by the upper rotation gear;

a ring gear being configured to engage the lower rotation gear, the ring gear being fastened to a support platform; and the lower rotation gear being configured to rotate an assembly of the lamp carrier frame, light source, and bearing ring inside the ring gear, as the lower rotation gear is driven by the upper rotation gear in response to the rotation adjustment screw.

4. The adjustment mechanism for a directional recessed luminaire of claim 1, wherein the first, second, third, and fourth linkages of the four bar linkage adjustment mechanism are configured to move in parallel planes.

5. The adjustment mechanism for a directional recessed luminaire of claim 1, wherein the four bar linkage adjustment mechanism is a first four bar linkage adjustment mechanism provided at a first side of the directional recessed luminaire, and wherein the adjustment mechanism further comprises a second four bar linkage adjustment mechanism provided at a second side of the directional recessed luminaire.

6. The adjustment mechanism for a directional recessed luminaire of claim 1, wherein the path defined by the four bar linkage adjustment mechanism is an arcuate path, and wherein the four bar linkage adjustment mechanism is configured to move the lamp carrier frame and the light source between a minimum adjustment position and a maximum adjustment position.

7. The adjustment mechanism for a directional recessed luminaire of claim 6, wherein in the minimum adjustment position the direction of light from the light source is substantially in the vertical direction, and wherein in the maximum adjustment position the direction of light from the light source is substantially at an acute angle to the vertical direction.

8. An adjustment mechanism for a directional recessed luminaire comprising:

a tilt adjustment screw supported on a bearing ring of a directional recessed luminaire, the tilt adjustment screw being oriented in a vertical direction and accessible for rotation by a tool inserted through an open center of the bearing ring, the tilt adjustment screw being configured to adjust a vertical tilt of a lamp carrier frame supported on the bearing ring, to vertically lift or lower a direction of light from a light source in the lamp carrier frame, with respect to an area to be illuminated by the light source;

a rotation adjustment screw supported in an adjacent position to the tilt adjustment screw on the bearing ring, the rotation adjustment screw being oriented in the vertical direction and accessible for rotation by the tool inserted through the open center of the bearing ring, the rotation adjustment screw being configured to adjust a horizontal angle orientation of the lamp carrier frame by rotating the bearing ring, to horizontally rotate the direction of light from the light source, with respect to the area to be illuminated;

a follower in threaded engagement with the tilt adjustment screw, the follower being configured to travel in the vertical direction on the tilt adjustment screw when the tilt adjustment screw is rotated;

a drive link connected to both the follower and a first linkage of a four bar linkage adjustment mechanism of the directional recessed luminaire, the drive link being configured to transfer force from the follower to the first linkage when the tilt adjustment screw is rotated;

the first linkage and a second linkage of the four bar linkage adjustment mechanism, being configured to pivot about respective first and second anchor points on a third linkage that is part of the bearing ring;

the first and second linkages being pivotally connected to respective first and second pivots on a fourth linkage of the four bar linkage adjustment mechanism, the fourth linkage being part of the lamp carrier frame that supports the light source of the directional recessed luminaire; and the pivoting of the first and second linkages, being configured to move the fourth linkage, lamp carrier frame, and light source along a path defined by the four bar linkage adjustment mechanism, when the tilt adjustment screw is rotated.

9. The adjustment mechanism for a directional recessed luminaire of claim 8, wherein once an aiming angle of the light source is set by rotating the tilt adjustment screw to position the follower along the tilt adjustment screw, the aiming angle is locked and cannot be changed by applying force to the adjustment mechanism in the absence of rotating the tilt adjustment screw.

10. The adjustment mechanism for a directional recessed luminaire of claim 8, further comprising:

an upper rotation gear being configured to rotate with the rotation adjustment screw;

a lower rotation gear being configured to engage with and be driven by the upper rotation gear;

a ring gear being configured to engage the lower rotation gear, the ring gear being fastened to a support platform; and the lower rotation gear being configured to rotate an assembly of the lamp carrier frame, light source, and bearing ring inside the ring gear, as the lower rotation gear is driven by the upper rotation gear in response to the rotation adjustment screw.

11. The adjustment mechanism for a directional recessed luminaire of claim 10, wherein once an aiming angle of the light source is set by rotating the tilt adjustment screw to position the follower along the tilt adjustment screw, the aiming angle is locked and cannot be changed by applying force to the adjustment mechanism in the absence of rotating the tilt adjustment screw.

12. The adjustment mechanism for a directional recessed luminaire of claim 8, wherein the four bar linkage adjustment mechanism is a first four bar linkage adjustment mechanism provided at a first side of the directional recessed luminaire, and wherein the adjustment mechanism further comprises a second four bar linkage adjustment mechanism provided at a second side of the directional recessed luminaire.

13. The adjustment mechanism for a directional recessed luminaire of claim 8, wherein the path defined by the four bar linkage adjustment mechanism is an arcuate path, and wherein the four bar linkage adjustment mechanism is configured to move the lamp carrier frame and the light source between a minimum adjustment position and a maximum adjustment position.

14. The adjustment mechanism for a directional recessed luminaire of claim 13, wherein in the minimum adjustment position the direction of light from the light source is substantially in the vertical direction, and wherein in the maximum adjustment position the direction of light from the light source is substantially at an acute angle to the vertical direction.

15. A method of adjusting a directional recessed luminaire, comprising:

providing a directional recessed luminaire with an adjustment mechanism, the adjustment mechanism comprising:

a tilt adjustment screw engaged with a bearing ring of a directional recessed luminaire, the tilt adjustment screw being oriented in a vertical direction and accessible for rotation by a tool inserted through an open center of the bearing ring, the tilt adjustment screw being configured to adjust a vertical tilt of a lamp carrier frame supported on the bearing ring, to vertically lift or lower a direction of light from a light source in the lamp carrier frame, with respect to an area to be illuminated by the light source;

a rotation adjustment screw engaged with the bearing ring in an adjacent position to the tilt adjustment screw, the rotation adjustment screw being oriented in the vertical direction and accessible for rotation by the tool inserted through the open center of the bearing ring, the rotation adjustment screw being configured to adjust a horizontal angle orientation of the lamp carrier frame by rotating the bearing ring, to horizontally rotate the direction of light from the light source, with respect to the area to be illuminated;

a follower in threaded engagement with the tilt adjustment screw;

a drive link connected to both the follower and a first linkage of a four bar linkage adjustment mechanism of the directional recessed luminaire;

the first linkage and a second linkage of the four bar linkage adjustment mechanism being configured to pivot about respective first and second anchor points on a third linkage that is part of the bearing ring; and the first and second linkages being pivotally connected to respective first and second pivots on a fourth linkage of the four bar linkage adjustment mechanism, the fourth linkage being part of the lamp carrier frame that supports the light source of the directional recessed luminaire;

adjusting a rotational orientation of the directional recessed luminaire by rotating the rotation adjustment screw to rotate the bearing ring; and adjusting the vertical tilt of the directional recessed luminaire by rotating the tilt adjustment screw to vertically lift or lower the direction of light from the light source in the lamp carrier frame with respect to the area to be illuminated by the light source, wherein, when the tilt adjustment screw is rotated, pivoting of the first and second linkages moves the fourth linkage, lamp carrier frame, and light source along a path defined by the four bar linkage adjustment mechanism.

16. The method of claim 15, wherein rotating the rotation adjustment screw rotates an upper rotation gear, wherein rotating the upper rotation gear drives a lower rotation gear and a ring gear being engaged with the lower rotation gear and fastened to a support platform, and wherein driving the lower rotation gear rotates an assembly of the lamp carrier frame, light source, and bearing ring inside the ring gear.

17. The method of claim 15, wherein the path defined by the four bar linkage adjustment mechanism is an arcuate path, and wherein adjusting the vertical tilt comprises moving the lamp carrier frame and the light source between a minimum adjustment position and a maximum adjustment position.

18. The method of claim 17, wherein in the minimum adjustment position the direction of light from the light source is substantially in the vertical direction, and wherein in the maximum adjustment position the direction of light from the light source is substantially at an acute angle to the vertical direction.

* * * * *